United States Patent [19]

Nomura et al.

[11] 4,129,981

[45] Dec. 19, 1978

[54] ELECTRONIC TIMEPIECE

[75] Inventors: Yasushi Nomura, Tokorozawa; Fumio Nakajima, Tokyo; Kenji Yamada, Koganei; Takayasu Machida, Iruma, all of Japan

[73] Assignee: Citizen Watch Company Limited, Tokyo, Japan

[21] Appl. No.: 764,790

[22] Filed: Feb. 2, 1977

[30] Foreign Application Priority Data

Feb. 6, 1976 [JP] Japan ..... 51-11973
Feb. 9, 1976 [JP] Japan ..... 51-13093

[51] Int. Cl.[2] ..... G04C 3/00
[52] U.S. Cl. ..... 58/23 D; 58/23 BA
[58] Field of Search ..... 58/23 R, 23 BA, 23 A, 58/50 R, 85.5, 28 R, 28 D, 34; 318/202, 206 R, 256, 267, 280, 293, 300

[56] References Cited

U.S. PATENT DOCUMENTS

| | | | |
|---|---|---|---|
| 3,668,859 | 6/1972 | Polin et al. | 58/23 R |
| 3,898,790 | 8/1975 | Takamune et al. | 58/23 BA |
| 3,998,043 | 12/1976 | Tamaru et al. | 58/23 R |
| 4,014,164 | 3/1977 | Fujita | 58/23 BA |
| 4,050,234 | 9/1977 | Toshio | 58/85.5 |

*Primary Examiner*—Robert K. Schaefer
*Assistant Examiner*—Vit W. Miska
*Attorney, Agent, or Firm*—Frank J. Jordan

[57] ABSTRACT

An electronic timepiece having a reversible stepping motor to actuate time-indicating hands to provide a time display, which comprises a driver circuit to produce driving current pulses composed of compound pulses appearing each time unit. A rotor of the stepping motor rotates a plurality of steps during each time unit to cause one of the time-indicating hands to advance through unequal intervals to provide a modulated display.

6 Claims, 15 Drawing Figures

ELECTRONIC TIMEPIECE

This invention relates to an analog electronic timepiece equipped with an electro-mechanical transducer and capable of providing a modulated display.

In conventional analog electronic timepieces having in addition to a time display function such functions as an alarm or warning function to indicate that the life of a battery has expired, it was necessary to provide additional display devices such as light emitting diodes or other photo-electric display means which change in appearance in order to notify the user that a given function is operating. Since these additional functions added to the cost of a timepiece and increased the size of the movement these efforts were not successful and the additional functions were abandoned. Such conventional timepieces although capable of providing two different kinds of hand movement, either continuous or intermittent, featured hands which advanced through fixed and equal intervals and thus were quite simple and could not compete with digital timepieces having the capability of providing a large number of functions in a small amount of space.

It is accordingly an object of this invention to provide an analog electronic timepiece which is capable of advancing the hands of the timepiece through unequal intervals to provide a modulated display.

It is another object of this invention to provide a timepiece in which the modulated display is used as the display means for displaying the operational states of additional functions.

It is another object of the present invention to provide an electronic timepiece equipped with a stepping motor adapted to be driven in a plurality of steps within every one unit time to thereby advance the hands of the timepiece through unequal intervals.

It is a further object of the present invention to provide an electronic timepiece including a stepping motor to advance the rotatable hands of the timepiece so as to provide a modulated display in a normal operating mode.

It is a further object of the present invention to provide an electronic timepiece including a stepping motor to advance the rotatable hands of the timepiece through unequal intervals to provide a modulated display in response to an output from a state sensor adapted to detect the operational states of the timepiece.

These and other objects, features and advantages of the present invention will become more apparent from the following description when taken in conjunction with the accompanying drawings, in which.

Figure 1:
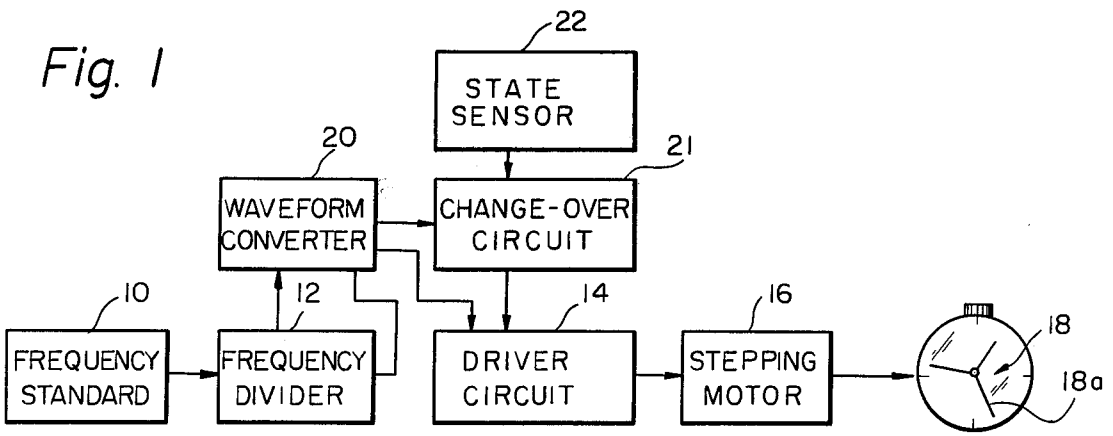
FIG. 1 is a block diagram of a preferred embodiment of an electronic timepiece according to the present invention.

Referring now to FIG. 1, there is shown a block diagram of a preferred embodiment of an electronic timepiece embodying the present invention. The electronic timepiece comprises a frequency standard 10 which is controlled by a quartz crystal (not shown) to produce a relatively high frequency signal of, for example, 32,768 Hz. This relatively high frequency signal is applied to a frequency divider 12 composed of a plurality of flip-flops (not shown) to produce a first low frequency signal of 1 Hz as a time unit signal, and a second low frequency signal which is higher in frequency than the first low frequency signal. The first low frequency signal is applied to a waveform converter 20 responsive to the first and second low frequency signals delivered from the frequency divider 12, to produce a first train of output pulses and second train of compound output pulses having the same polarity and delayed in phase from the first train of output pulses in response to the first low frequency signal. The first train of output pulses are applied to a driver circuit 14, which produces first driving current pulses in response to the first train of output pulses. These driving current pulses are applied to a stepping motor 16, which is driven stepwise to advance time-indicating hands 18 of the timepiece to display time. The second train of output pulses are applied through a change-over circuit 21 controlled by a state sensor 22 to the driver circuit 14, which produces second driving current pulses composed of a first pulse and second compound pulses appearing at predetermined timings during each time unit (i.e., per second) by which the stepping motor 16 rotates, a plurality of steps each in one of clockwise and counter-clockwise directions at the predetermined timings during each time unit. This rotation allows the seconds hand **18*a*** to advance at unequal intervals to provide a modulated display.

Figure 2:
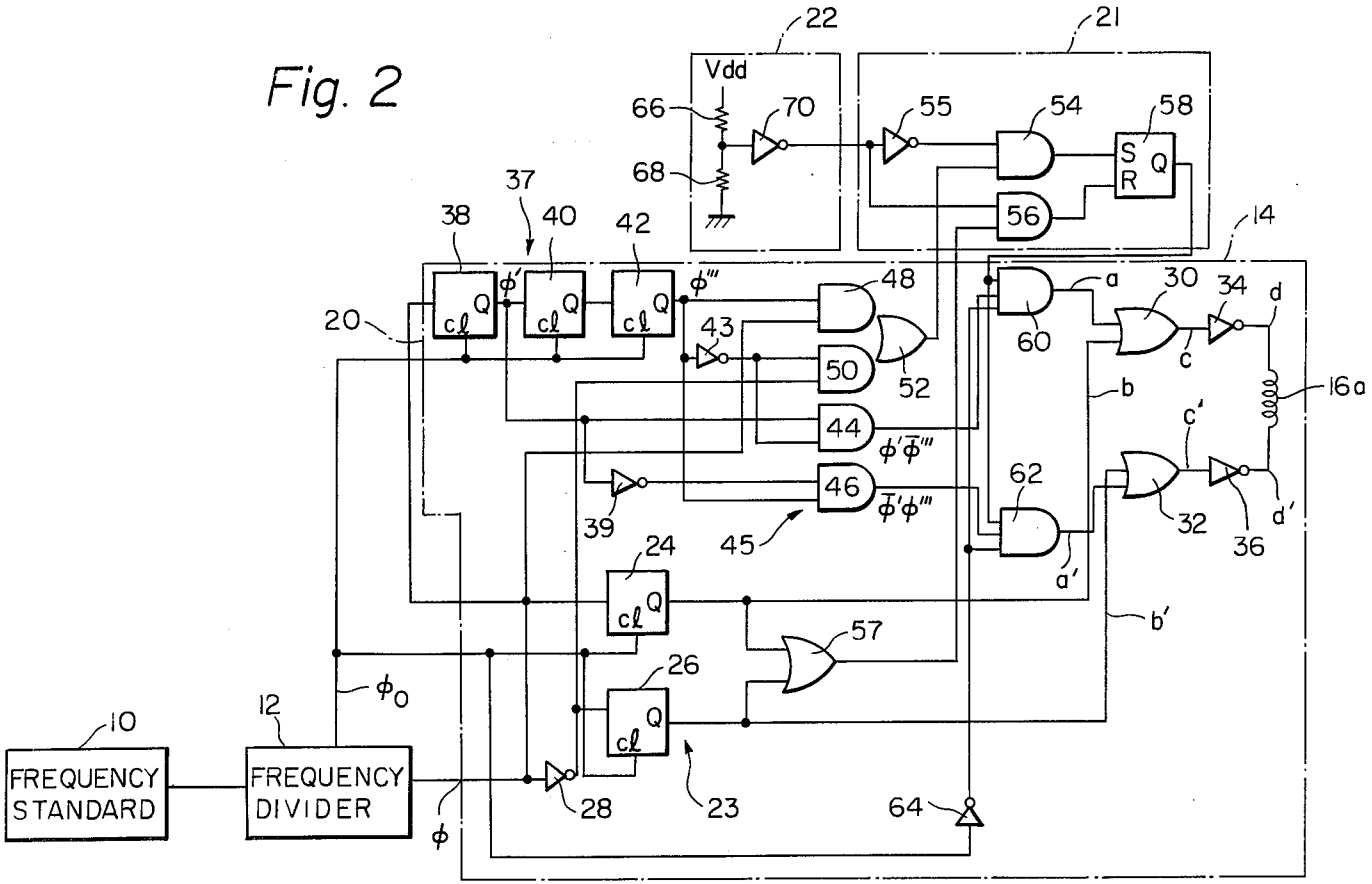
FIG. 2 is an example of a detail circuitry for the timepiece shown in FIG. 1.

FIG. 2 shows one example of the detail electric circuitry for the timepiece shown in FIG. 1. In FIG. 2, the waveform converter 20 comprises a first circuit section 23 composed of first and second positive going-edge triggered type flip-flops 24 and 26 having their inputs coupled to an output of the frequency divider 12 and an output of an inverter 28, respectively. An input of the inverter 28 is coupled to the output of the frequency divider 12 to receive the first low frequency signal $\phi$ therefrom. Clock input terminals of the flip-flops 24 and 26 are coupled to an intermediate stage of the frequency standard 12, to receive the second low frequency signal $\phi o$ therefrom. Outputs of the flip-flops 24 and 26 are coupled to the driver circuit 14 composed of OR gates 30 and 32 whose outputs are connected to inverters 34 and 36, respectively. Outputs of the inverters 34 and 36 are connected to a driving coil 16*a* of the stepping motor 16.

Figure 3:
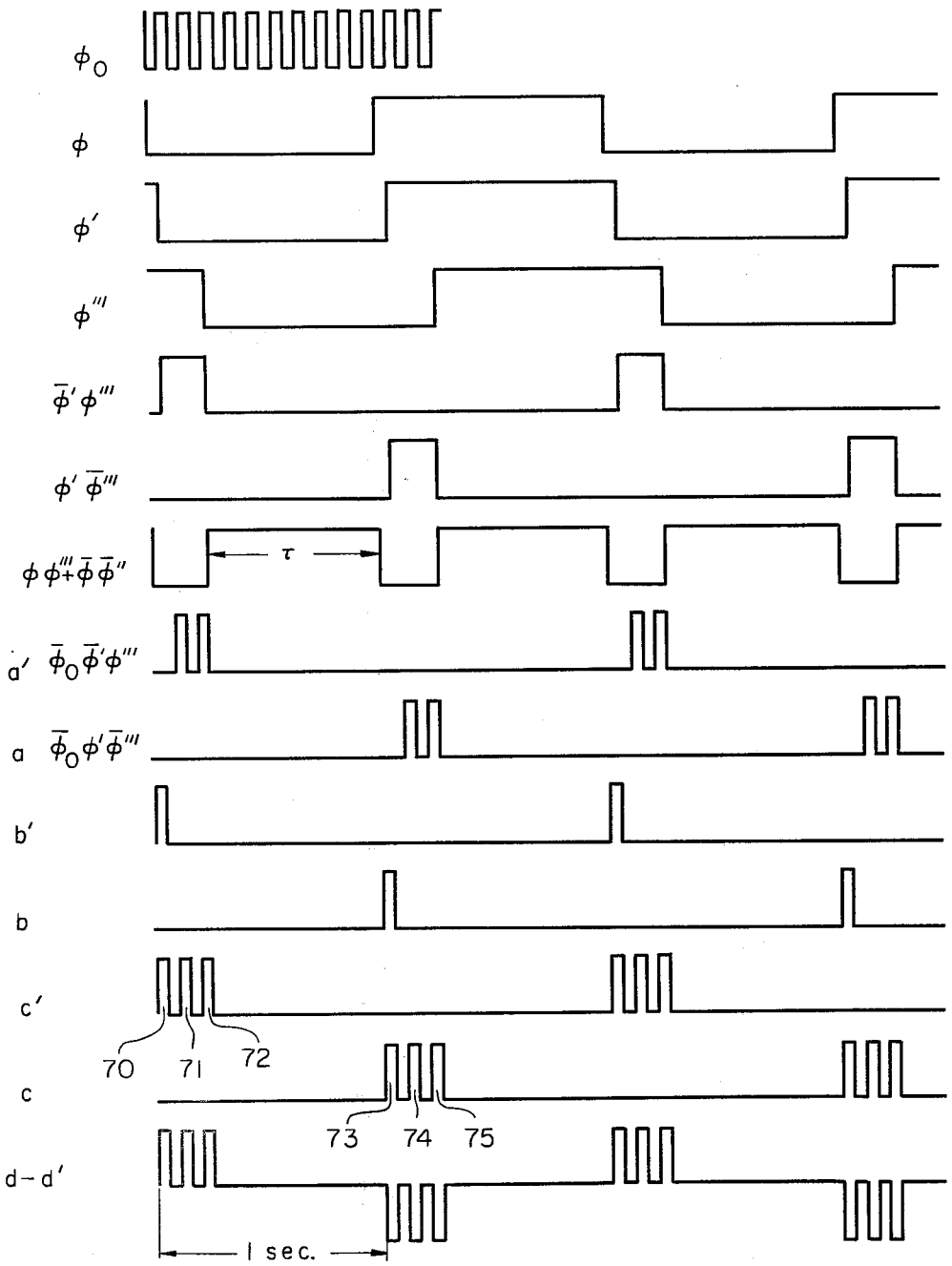
FIG. 3 is a waveform diagram illustrating the operation of the circuit shown in FIG. 2.

The waveform converter 20 also comprises a shift circuit 37 composed of first, second and third data-type flip-flops 38, 40 and 42 having their clock input terminals applied with the second low frequency signals $\phi o$ to provide outputs $\phi'$ and $\phi'''$ delayed in phase from each other. The output $\phi'$ of the first flip-flop 38 is directly applied to one input of an AND gate 44 and applied through an inverter 39 to one input of an AND gate 46. The remaining input of the AND gate 44 is coupled through an inverter 43 to the third flip-flop 42 to receive the output $\phi'''$, and the remaining input of the AND gate 46 is directly coupled to the output of the flip-flop 42. Thus, the AND gates 44 and 46 form part of a second circuit section 45 to generate output signals $\phi'\overline{\phi'''}$ and $\overline{\phi'}\phi'''$, respectively, as shown in FIG. 3. The output $\phi'''$ of the flip-flop 42 is directly applied to one input of an AND gate 48 and applied through the inverter 43 to one input of AND gate 50. The other input of the AND gate 48 is coupled to the output of the frequency divider 12 to receive the first low frequency signal therefrom, and the other input of the AND gate 50 is coupled through the inverter 28 to the output of the frequency divider 12 to receive the inverse of the low frequency signal $\phi$. Outputs of the AND gates 48 and 50 are coupled to inputs of an OR gate 52, which generates an output signal $\phi\phi''' + \overline{\phi}\overline{\phi'''}$ which is applied to one input of an AND gate 54 of the change-over circuit 21. As seen in FIG. 3, the output signal $\phi\phi''' + \overline{\phi}\overline{\phi'''}$ has a pulse width $\tau$ less than the interval between the normal driving pulses, to open the AND gate 54 so that the output of an inverter 55 is gated therethrough only during a predetermined time interval to prevent an error in operation. Thus, the gates 48, 50 and 52 serve as an erroneous operation preventive circuit. The other input of the AND gate 54 is coupled through the inverter 55 to an output of the state sensor 22, which is directly coupled to one input of an AND gate 56 whose remaining input is coupled to an output of an OR gate 57 having its inputs coupled to the outputs of the flip-flops 24 and 26 of the driver circuit 14. Outputs of the AND gates 54 and 56 are coupled to a set terminal S and a reset terminal R of flip-flop 58 whose Q output is directly coupled to first inputs of AND gates 60 and 62 to control these gates. The AND gates 60 and 62 serve as a compound pulse generator forming part of the second circuit section 45 and have second inputs both coupled through an inverter 64 to the intermediate stage of the frequency divider 12 to receive the inverse of the second low frequency signal $\phi o$. Third inputs of the AND gates 60 and 62 are coupled to the outputs of the AND gates 44 and 46, respectively. Outputs of the AND gates 60 and 62 are coupled to the remaining inputs of the OR gates 30 and 32 of the driver circuit 14.

In the circuit diagram of FIG. 2, the state sensor 22 is shown as a battery voltage drop detector which is composed of a resistor 66 connected to the positive side $V_{dd}$ of a battery, a nonlinear element 68 connected in series with the resistor 66, and an inverter 70 for voltage drop detection.

At normal voltage of the battery, the output of the inverter 70 is at a "1" logic level and the output of the inverter 55 is at a "0" logic level so that the AND gate 54 of the change-over circuit 21 no output. In this instance, outputs of the flip-flops 24 and 26 of the waveform converter 20 are applied through the OR gate 57 to the AND gate 56 which is opened by the output of the inverter 70. Therefore, the AND gate 56 generates an output by which the flip-flop 58 is reset, and the output of the change-over circuit 21 remains at "0" logic level. Consequently, the compound pulse generator composed of the AND gates 60 and 62 does not produce outputs at terminals a and a'. Under these circumstances, the flip-flops 24 and 26 of the waveform converter 20 provide output pulses at terminals b and b' in response to the first low frequency signal $\phi$ as shown in FIG. 3. These output pulses are applied through the OR gates 30 and 32 to the driving inverters 34 and 36, by which normal driving current pulses are generated. Thus, the stepping motor is driven stepwise to advance the rotatable hands 18 to provide time display.

When the battery voltage drops below a predetermined value, the output of the detection inverter 70 goes to a "0" logic level, inhibiting the AND gate 56. At the same time, the output of the inverter 55 goes to a "1" logic level and applied to the AND gate 54, which is opened in response to the output of the OR gate 52 of the erroneous operation preventive circuit to pass the output of the inverter 55 to the set terminal S of the flip-flop 58. Therefore, the flip-flop 58 is set and the output of the change-over circuit 21 goes to a "1" logic level. This output is applied to the AND gates 60 and 62 of the compound pulse generator, which is enabled to provide compound output pulses $\overline{\phi o}\phi'\overline{\phi'''}$ and $\phi o\overline{\phi'}\phi'''$ at terminals a and a'. These output pulses are applied to the OR gates 30 and 32, to which the output pulses b and b' are also applied. The OR gates 30 and 32 serves as synthesizing means which provides synthesized pulses 70 to 72 and 73 to 75 at the terminals c' and c as shown in FIG. 3. The synthesized pulses are applied to the driving inverters 36 and 34, by which modulated driving current pulses are generated as shown by the waveform d-d' in FIG. 3. The modulated current pulses are applied to the driving coil 16*a* of the stepping motor, which is driven at unequal intervals. More specifically, the stepping motor is rotated clockwise, counter-clockwise and clockwise at first, second and third steps, respectively, within several tens of milliseconds, each step having an interval corresponding to 1 seconds.

Figure 5:
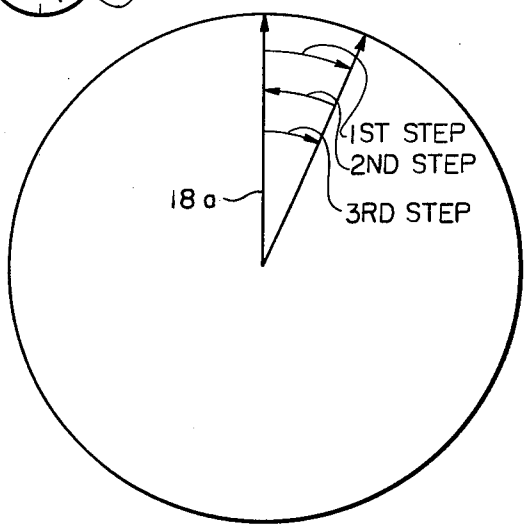
FIG. 5 is a view showing the movement of the seconds hand driven by the stepping motor shown in FIG. 4.
Figure 4:
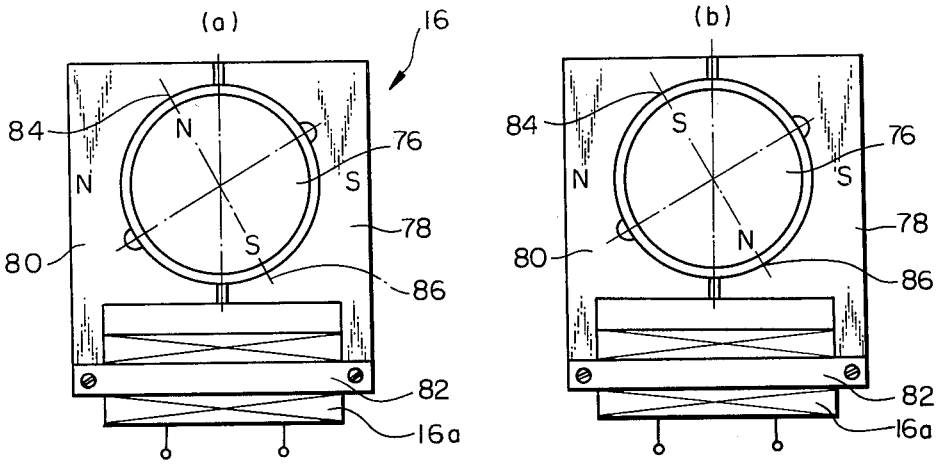
FIG. 4 is a schematic view of a preferred example of a reversible stepping motor incorporated in the timepiece shown in FIG. 1.

FIG. 4 shows an example of the stepping motor 16 adapted to be driven by the modulated driving current pulses mentioned above. In FIG. 4, the stepping motor 16 comprises a permanent magnet rotor 76, stators 78 and 80, and the driving coil 16*a*. In FIG. 4, the pulse 70 is applied to the driving coil 16*a* through which a current is therefore caused to flow. This brings the stator 78 to a state of South magnetization and stator 80 to a state of North magnetization such that the rotor 76 rotates clockwise in the first step as shown in FIGS. 4(*b*) and 5. In FIG. 4, reference numeral 82 denotes the core of the driving coil, and 84 and 86 designate points of static equilibrium. When the pulse 71 arrives under these conditions the stators 78 and 80 are excited and brought to the same states of magnetization as mentioned above so that the rotor 76 now rotates counter-clockwise in the second step as shown in FIG. 5 and returns to the attitude shown in FIG. 4(*a*). When the pulse 72 arrives the stators 78 and 80 are once again brought to respective states of South and North magnetization and the rotor 76 thus rotates in a third step as shown in FIG. 5 returning to the attitude it had in FIG. 4(*b*). The rotor in this fashion rotates between points of static equilibrium.

This clockwise-counterclockwise rotation is used to modulate the seconds hand 18*a* of the time-indicating mechanism 18 (see FIG. 1) which is coupled through the dial train drive to the stepping motor 16 such that the seconds hand follows this clockwise-counterclockwise movement. This modulated movement can be completed within several tens of milliseconds and will be repeated every one second, the seconds hand providing a modulated display.

One second after the initial pulse 70 has been applied the pulse 73, arrives and brings the stator 78 to a state of North magnetization and the stator 80 to a state of South magnetization whereby the rotor 76 rotates clockwise and assumes the attitude shown in FIG. 4(*a*). When the pulse 74 arrives under these conditions the stators 78 and 80 are once again brought to respective states of North and South magnetization such that the rotor 76 now rotates counter-clockwise to the attitude shown in FIG. 4(*b*). When the pulse 75 arrives the same states of magnetization are again induced and the rotor 76 thus rotates clockwise to the attitude shown in FIG. 4(*a*). Again the rotor 76 rotates between points of static equilibrium. As was previously the case, this clockwise-counterclockwise rotation modulates the seconds hand, thereby allowing the second hand to follow the clockwise-counterclockwise movement. This operation continues in a repetitive manner, modulating the seconds hand of the display device so that a drop in the battery voltage is clearly indicated.

Figure 7:
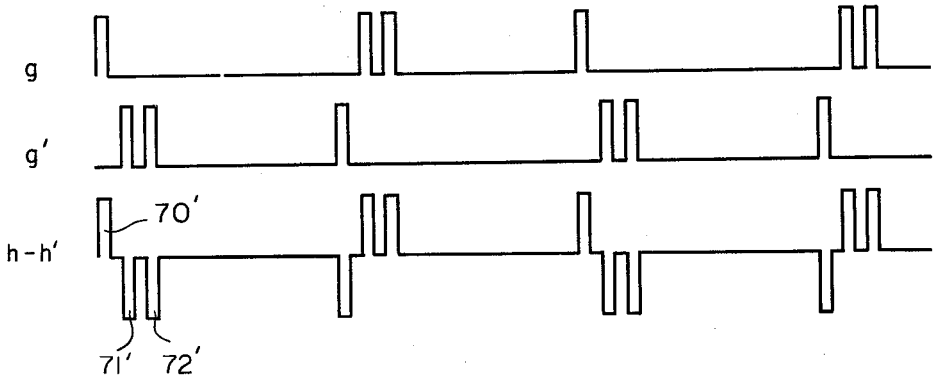
FIG. 7 is a waveform diagram showing various pulses obtained by the circuit of FIG. 6.
Figure 8:
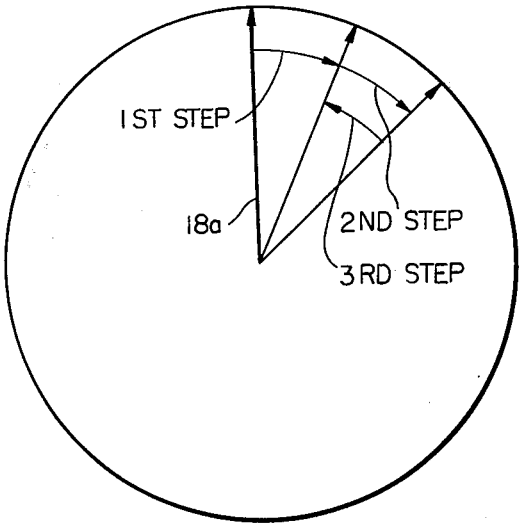
FIG. 8 is a view illustrating the movement of the seconds hand attained by the circuit of FIG. 6.
Figure 6:
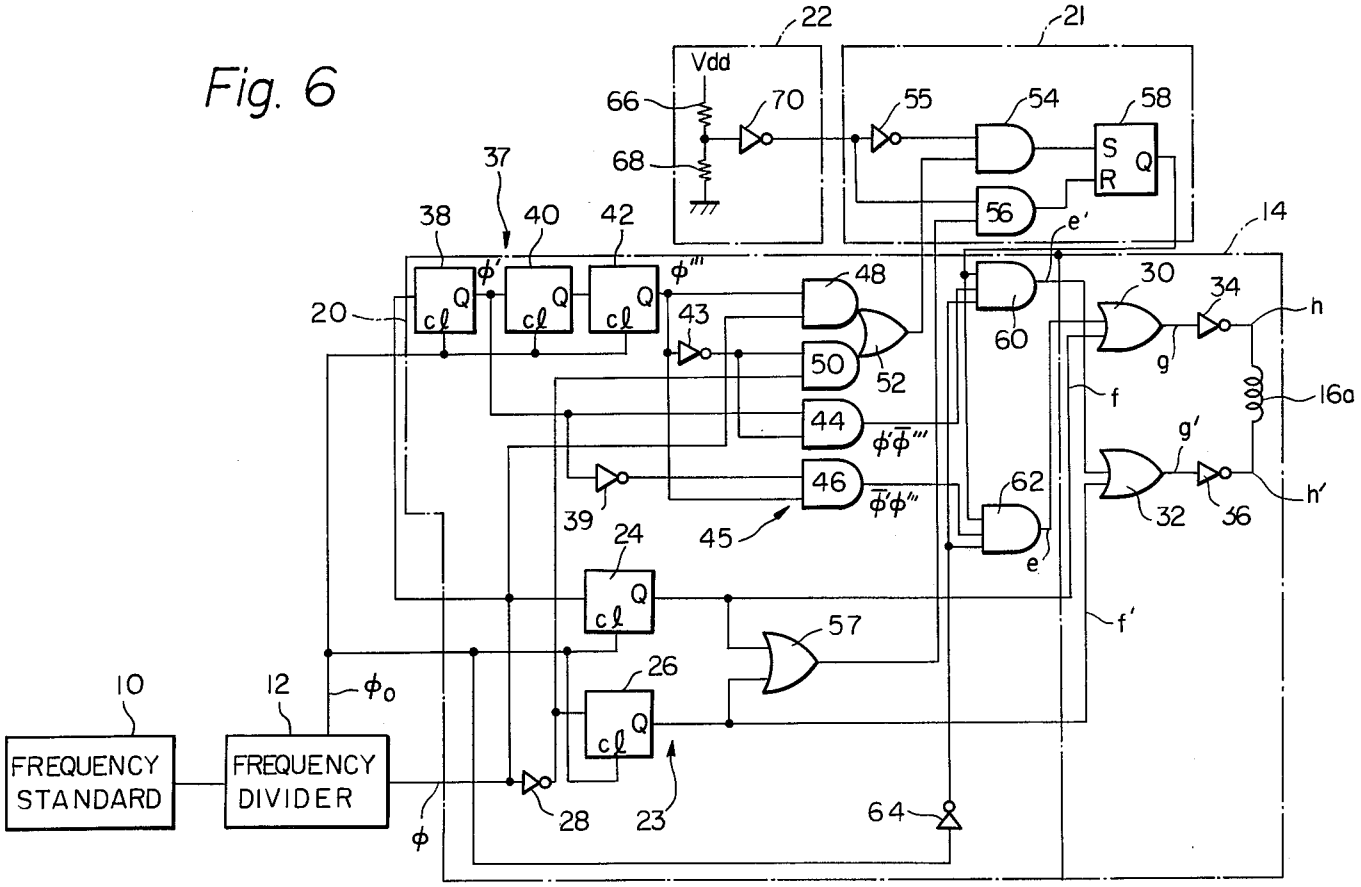
FIG. 6 is another example of a detail circuitry for the timepiece shown in FIG. 1.

FIG. 6 depicts a modified form of the circuit shown in FIG. 2. The circuitry shown is substantially identical with that of FIG. 2, except that the output of the AND gate 60 is connected to one input terminal of the OR gate 32 and the output of the AND gate 62 is connected to one input terminal of the OR gate 30. The waveforms which appear at output terminals g, g' are as shown in FIG. 7, and the driving coil 16*a* is supplied with modified alternating current pulses h-h' so that a driving current flows through its windings. The alternating current pulses h-h' are composed of a pulse train of three successive pulses 70', 71' and 72'. These successive pulses will cause the stepping motor to rotate in a clockwise-clockwise-counterclockwise manner which will modulate the seconds hand of the display such that the seconds hand follow this clockwise-clockwise-counterclockwise rotation in first, second and third steps as shown in FIG. 8. In this case the seconds hand 18*a* is advanced through intervals corresponding to two seconds during first and second steps and caused to return to the one second position during the third step. In this manner, the seconds hand 18*a* provides a modulated display.

Thus in accordance with a feature of the invention a drop in battery voltage is detected by a detecting device and the hands of a display device for a timepiece which employs a reversible stepping motor are modulated in order to clearly indicate that the battery should be replaced. This makes it possible to effect the replacement before the hands of the timepiece come to a halt. It is also possible to adapt the invention in such a way that the detecting device is utilized to detect the temperature within the timepiece and thus modulate the display to give a clear indication of an abnormal internal temperature. A further modification can be made in which the detector is adapted to detect the humidity within the timepiece. Thus a rise in the humidity would be detected and the hands of the display appropriately modulated to give the proper indication. It is also possible to detect certain specified times or dates of which the following are some examples:

(1) The compound modulated display can be adapted so that the hands of the display begin to be modulated at a specific time each day; the daily lunch hour or coffee break, for example.

(2) The compound modulated display can be adapted so that the hands of the display are modulated on a specified day such as a birthday.

(3) It is also possible to provide differing compound modulated displays for a specified respective time, date and day of the week. For example, changes in the days of the week can be discriminated by employing a compound modulated display without providing a separate display device for the week display.

By combining these features and varieties of hand movement with a normal method of time display it is possible to realize a unique, hitherto unavailable electronic timepiece characterized by a highly variable display.

Figure 9:
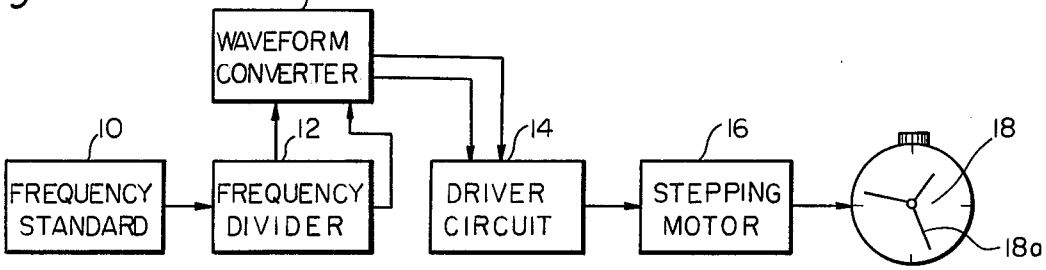
FIG. 9 is a block diagram of a modification of the timepiece shown in FIG. 1.

While in the preferred embodiment of FIG. 1 the electronic timepiece has been shown as including the state sensor 22 and the change-over circuit 21, these components may be dispensed with as shown by a block diagram of FIG. 9 in which like or corresponding components are designated by the same reference numerals as those used in FIG. 1. In this case, the erroneous operation preventive circuit of the waveform converter 20 may be directly coupled to the compound pulse generator or may be dispensed with. With this arrangement, the compound pulse generator of the waveform converter 20 generates compound output pulses in normal operation mode of the timepiece. These compound pulses are applied to the synthesizer of the driver circuit 14, by which modulated driving pulses are generated in the normal timekeeping mode such that the stepping motor 16 advances the seconds hand 18*a* at unequal intervals to provide a modulated display in the normal operation.

Figure 10:
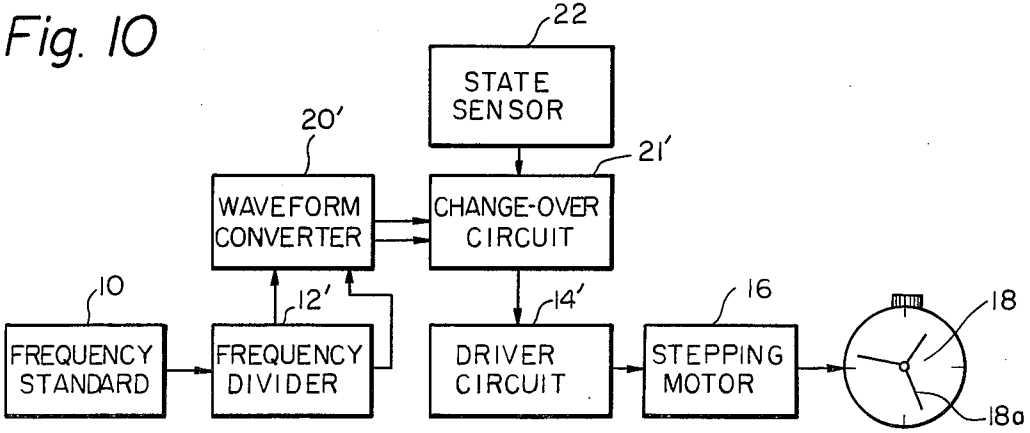
FIG. 10 is a block diagram of another preferred embodiment of the electronic timepiece according to the present invention.

A modified form of the electronic timepiece is shown in FIG. 10, in which like or corresponding component parts are designated by the same reference numerals as those used in FIG. 1 with the exception that a single prime (') has been added to those numerals indicative of modified elements. In this modification, a waveform converter 20' generates first output pulses composed of a plurality of single pulses, and second output pulses composed of a single pulse and compound pulses in response to low frequency signals from a frequency divider 12'. The first and second output pulses are selectively passed through a change-over circuit 21' controlled by a state sensor 22 to a driver circuit 14'. The driver circuit 14' generates normal driving pulses and modulated driving pulses in response to the first and second output pulses delivered from the waveform converter 20'. When the normal driving pulses are applied to a stepping motor 16, it rotates clockwise stepwise at an equal interval to advance rotatable hands 18 in a normal mode to provide normal time display. When, however, the modulated driving pulses are applied to the stepping motor 16, it causes the seconds hand 18*a* to advance at unequal intervals to provide a modulated display, indicating particular states of the timepiece such as those previously stated.

Figure 11A:
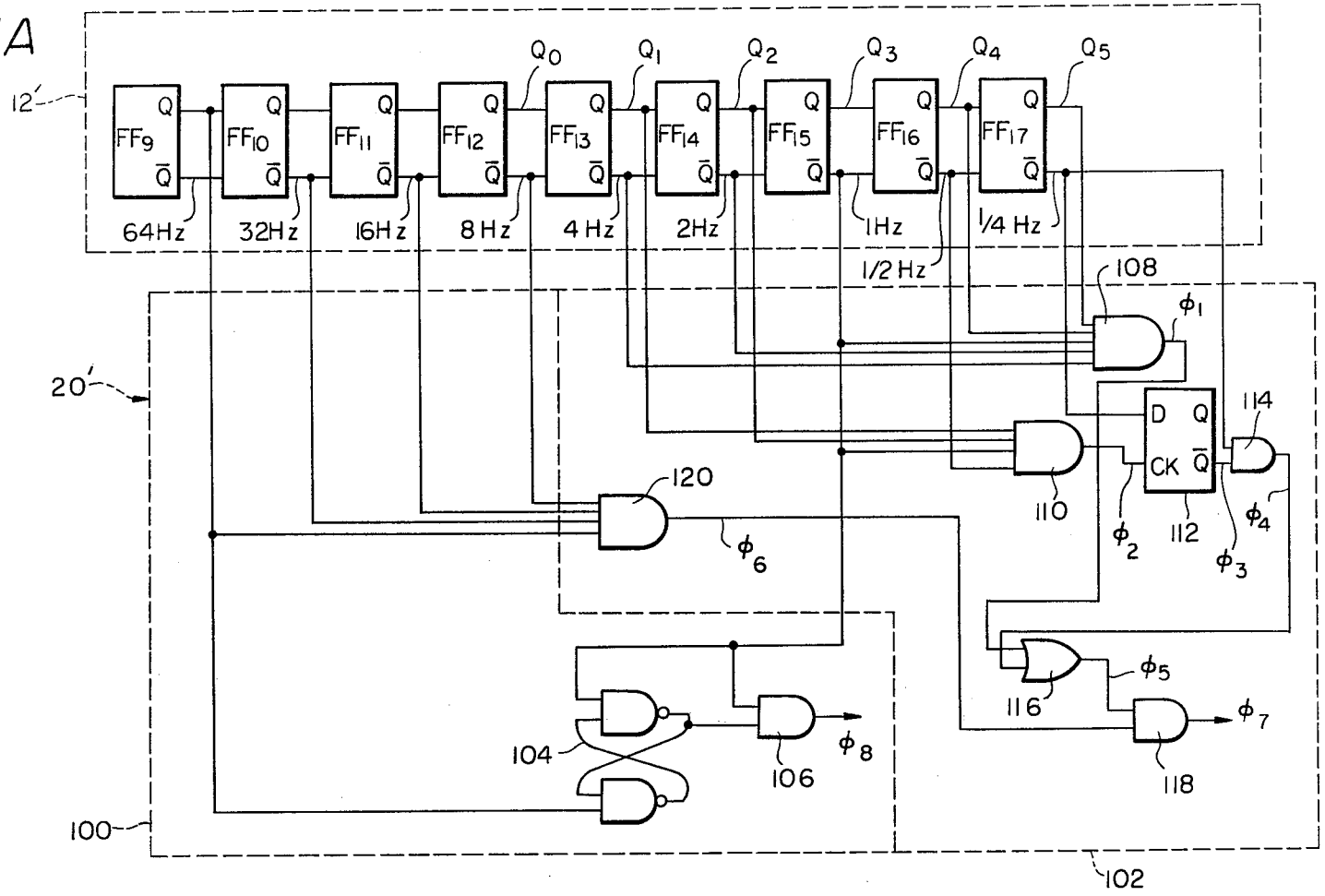
FIGS. 11A and 11B show an example of a detail circuitry for the timepiece shown in FIG. 10.
Figure 11B:
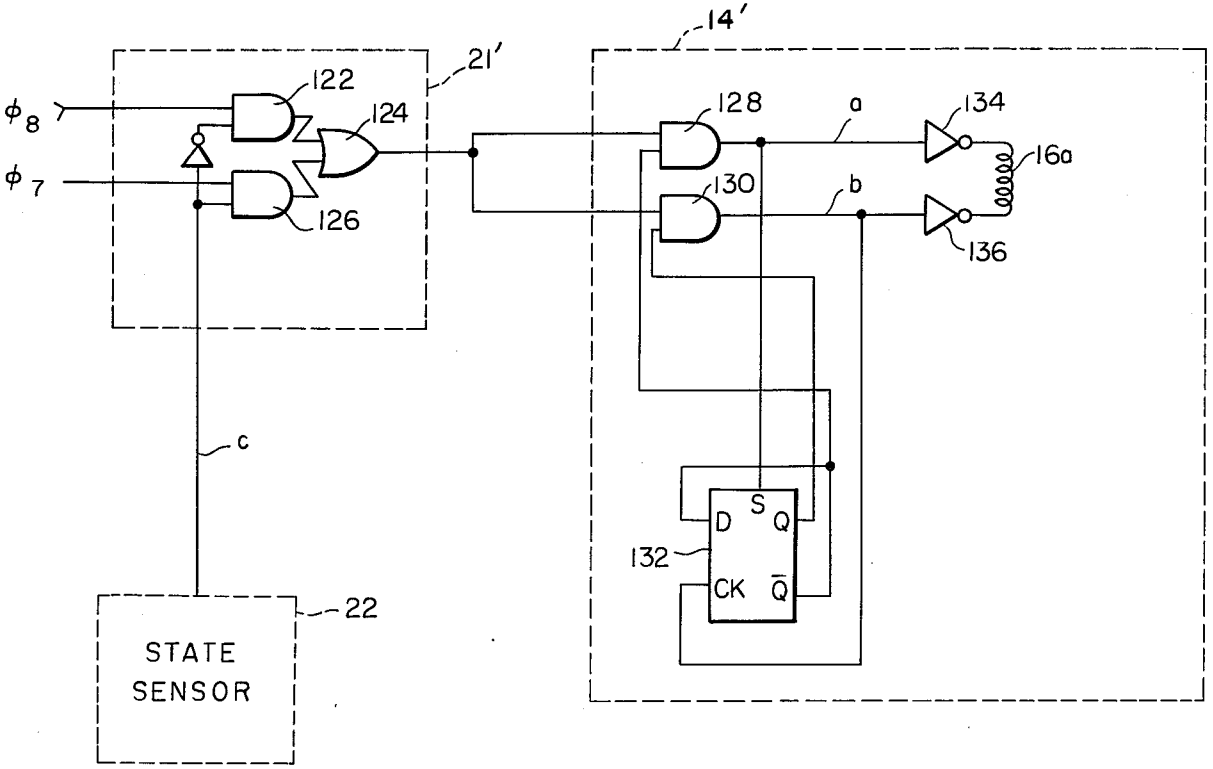
Figure 12A:
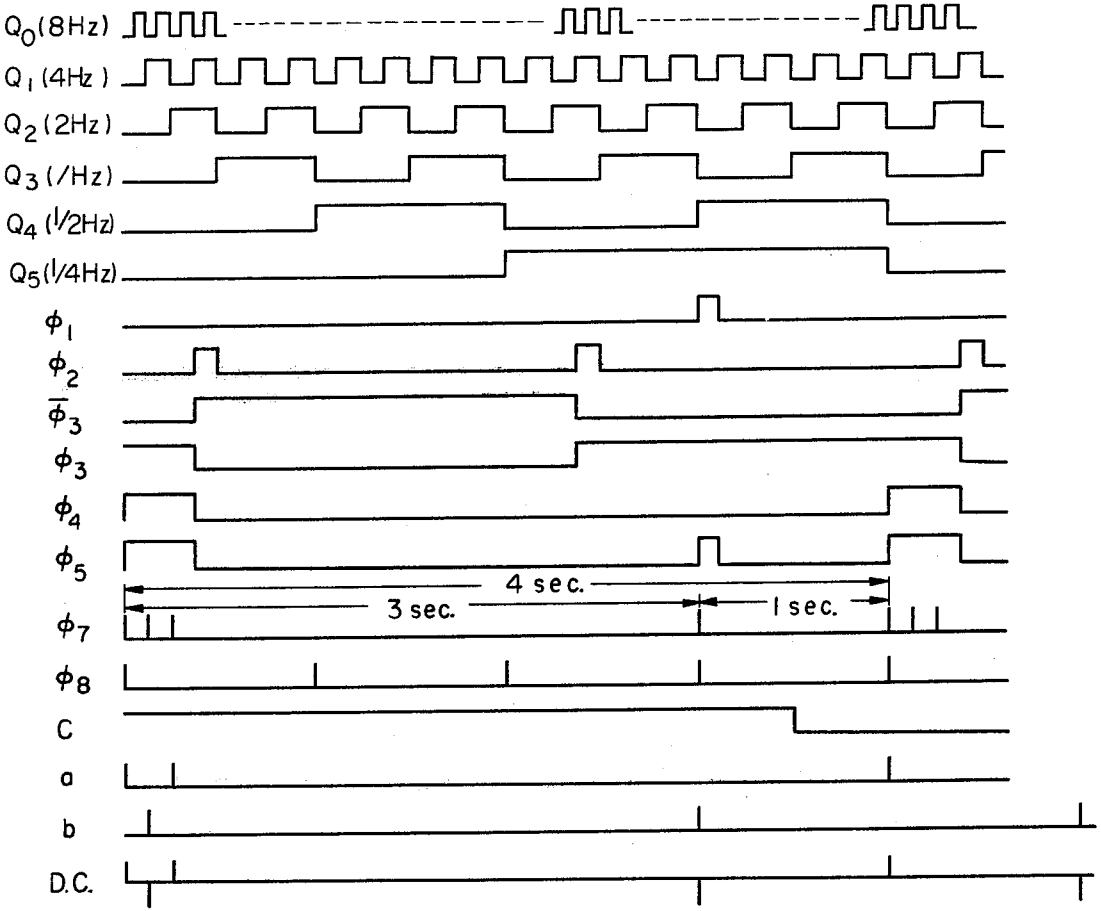
FIGS. 12A and 12B show a waveform diagram showing various pulses produced in the circuit of FIGS. 11A and 11B.
Figure 12B:
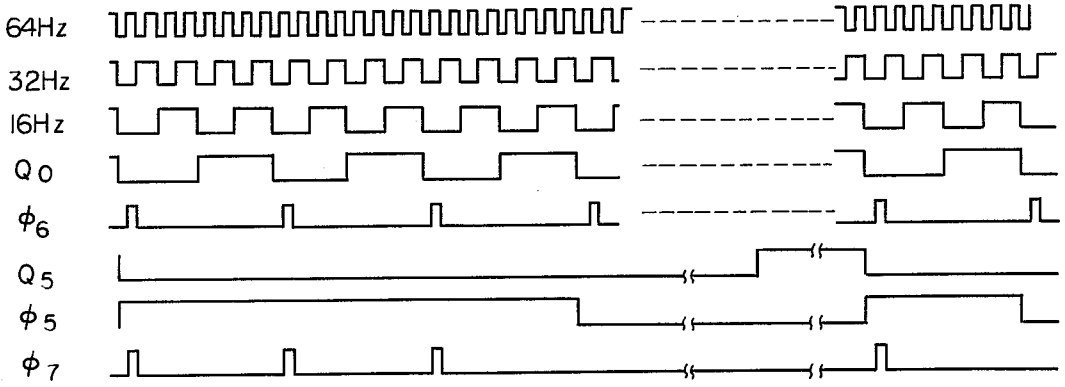

As shown in FIG. 11A, the frequency divider 12' comprises a plurality of flip-flops, of which only FF9 to FF17 are shown. The waveform converter 20' comprises a first circuit section 100 and a second circuit section 102. The first circuit section 100 includes a flip-flop 104 having its one input coupled to the Q output of the flip-flop FF9 and another input coupled to the $\overline{Q}$ output of the flip-flop FF15, and an AND gate 106 having its one input coupled to an output of the flip-flop 104 and another input coupled to the $\overline{Q}$ output of the flip-flop FF15. The Q output of the flip-flop FF9 has a frequency of 64 Hz, and the $\overline{Q}$ output of the flip-flop FF15 has a frequency of 1 Hz. The AND gate 108 generates first output pulses $\phi_8$ per every 1 second. The output pulses $\phi$ are passed through the change-over circuit 21' to the driver circuit 14' as will be described later. The second circuit section 102 comprises an AND gate 108 and 110. The AND gate 108 has inputs coupled to the $\overline{Q}$ outputs of the flip-flops FF13 to FF15, and Q outputs of the flip-flops FF16 and FF17, to provide an output $\phi_1$ as shown in FIG. 12A. The AND gate 110 has inputs coupled to the Q outputs of the flip-flops FF13 and FF14 and $\overline{Q}$ outputs of the flip-flops FF15 and FF16, to provide an output $\phi_2$, which is applied to a clock input terminal of a negative going-edge triggered type flip-flop 112. The data input terminal of the flip-flop 112 is coupled to the $\overline{Q}$ output of the flip-flop FF17, to provide an output $\phi_3$. The output $\phi_3$ and the $\overline{Q}$ output of the flip-flop FF17 are applied to an AND gate 114, which provides an output $\phi_4$. The output $\phi_4$ is applied to one input of an OR gate 116, to the other input of which is applied the output $\phi_1$. Thus, the OR gate 116 provides an output $\phi_5$ which is applied to one input of an AND gate 118 to the other input of which is applied an output $\phi_6$ of an AND gate 120. The AND gate 120 has inputs coupled to the Q output of the flip-flop FF9 and the $\overline{Q}$ outputs of the flip-flops FF10 to FF12. The AND gate 118 generates an output $\phi_7$ in response to the output $\phi_5$ and $\phi_6$. The outputs $\phi_5$, $\phi_6$ and $\phi_7$ are shown in an enlarged scale in FIG. 12B. As best shown in FIG. 12A, the output $\phi_7$ is composed of compound pulses appearing at every 4 seconds, and a single pulse appearing 3 seconds after the first pulse of the compound pulses. The outputs $\phi_7$ and $\phi_8$ are applied to the change-over circuit 21'. When an output C of the state sensor 22 is at a low logic level, an AND gate 122 is opened to pass the output $\phi_8$ to the driver circuit 14'. When, however, the output C goes to a high logic level, an AND gate 126 is opened to pass the output $\phi_7$ to the driver circuit 14'.

Figure 13:
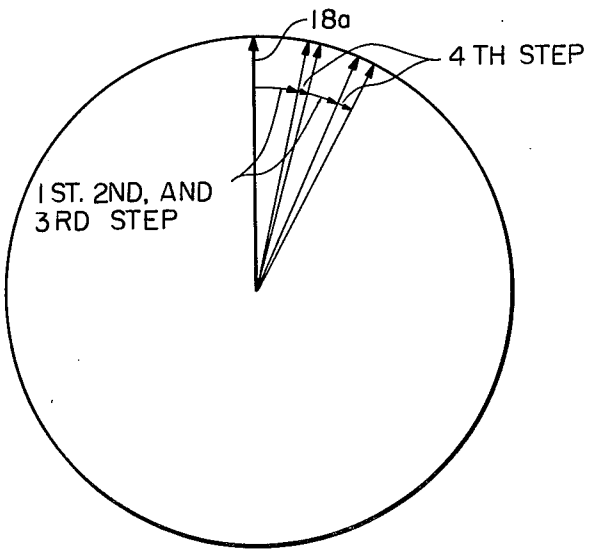
FIG. 13 is a view showing the movement of the seconds hand of the timepiece shown in FIG. 10.

The driver circuit 14' comprises and Gates 128 and 130, a negative going-edge triggered type data type flip-flop 132, and driving inverters 134 and 136. Inputs of the AND gates 128 and 130 are coupled to an output of an OR gate 124 of the change-over circuit 21', and the remaining inputs are coupled to the $\overline{Q}$ output and Q output of the flip-flop 132, respectively. The data input terminal of the flip-flop 132 is also coupled to the $\overline{Q}$ output of the flip-flop 132. The set terminal of the flip-flop 132 is coupled to an output of the AND gate 128, and the clock input terminal is coupled to an output of the AND gate 130. The AND gates 128 and 130 generate outputs a and b as shown in FIG. 12A, and the driving inverters 134 and 136 generate driving pulses D.C. having the waveform shown in FIG. 12A. As shown in FIG. 12A, when the output C is at a high logic level, the driving inverters 134 and 136 produce driving pulses composed of compound pulses 140, 141 and 142 and a single pulse 143. Therefore, the rotor of the stepping motor 16 rotates in clockwise-clockwise-clockwise manner during first, second and third steps in response to the compound pulses 141, 142 and 143 within several tens of milliseconds such that the seconds hand 18a advances through intervals of 3 seconds as shown in FIG. 13. Three seconds after the initial pulse 140 has been applied the pulse 143 is applied to the driving coil 16a, and the rotor rotates clockwise one step through an interval of one second. This clockwise-clockwise-clockwise rotation will be repeated each unit time of four seconds such that the seconds hand 18a provides a modulated display. When the output C is at a low logic level, the driving inverters 134 and 136 produce alternating driving pulses at 1 Hz so that the seconds hand 18a advances one step per one second.

It will now be appreciated from the foregoing description that in accordance with the present invention the rotatable hands of the timepiece are advanced through unequal intervals during each unit time for thereby providing a modulated display.

While the present invention has been shown and described with reference to particular embodiments in which the seconds hand is adapted to provide a modulated display, it should be noted that in a case where the electronic timepiece includes only a minutes and hours hands the minutes hand may be advanced through unequal intervals in a manner as previously described to provide a modulated display. It should also be understood that one of the rotatable hands may be rotated counterclockwise in a first step and rotated clockwise in second and third steps in a repetitive fashion to provide a modulated display.

What is claimed is:

1. An electronic timepiece, in combination, comprising:

a frequency standard providing a relatively high frequency signal;

a frequency divier providing relatively low frequency signals in response to said relatively high frequency signals;

a waveform converter including first circuit means responsive to said relatively low frequency signals to provide a single output pulse each unit of time, second circuit means for producing composite output pulses each unit of time in response to said relatively low frequency signals which composite output pulses are delayed in phase from said single output pulse, and synthesizing circuit means for providing a synthesized signal composed of said single output pulse and said composite output pulses appearing each unit of time;

a driver circuit for producing a first drive signal composed of said single output pulses each unit of time and a second driving signal composed of said synthesized signal;

means for selectively rendering said second circuit means operative in dependence on an operational state of the timepiece;

a reversible stepping motor including a driving coil, a rotor, and a stator including means for driving said rotor in a forward step each unit of time when said first driving signal is applied to said driving coil and driving said rotor several steps in forward and backward directions each unit of time when said second driving signal is applied to said driving coil; and display means including at least one hand adapted to be driven by said rotor and normally rotating forward step each unit of time in response to each forward rotation of said rotor, to indicate time data, while rotating several steps in forward and backward directions in response to each forward and backward rotation of said rotor, to indicate said operational state of the timepiece.

2. An electronic timepiece according to claim 1, in which said rendering means comprises sensing means for sensing said operational state of the timepiece to provide an output signal in dependence thereon; and a change-over circuit normally held in its inoperative condition and responsive to the output signal from the sensing means to provide an output to render said second circuit means operative.

3. An electronic timepiece according to claim 2, in which said relatively low frequency signals comprise first and second relatively low frequency signals 1, and in which said second circuit means includes a shift circuit coupled to said frequency divider to produce first output signals delayed in phase from said first low frequency signal in response to said second low frequency signal, gate means responsive to said first output signals to produce second output signals, and composite pulse generating means responsive to said second output signals and said second low frequency signal to produce said composite output pulses.

4. An electronic timepiece according to claim 2, in which said sensing means comprises a battery voltage detector adapted to generate said output signal when said battery voltage drops below a predetermined value.

5. An electronic timepiece according to claim 3, in which said second circuit means further includes an erroneous operation preventive circuit responsive to said first output signals and said first low frequency signal to apply the output signal from said sensing means to said change-over circuit only during a predetermined time interval.

6. An electronic timepiece according to claim 3, in which said change-over circuit includes gate means responsive to said output signal from said sensing means, and a flip-flop having its set terminal coupled to an output of said gate means and its output coupled to said composite pulse generating means.

* * * * *